US005651256A

United States Patent [19]

Herd et al.

[11] Patent Number: 5,651,256

[45] Date of Patent: Jul. 29, 1997

[54] SUPERCONDUCTIVE MAGNET HAVING A THERMAL SHIELD

[75] Inventors: Kenneth Gordon Herd, Niskayuna; Bizhan Dorri, Clifton Park, both of N.Y.

[73] Assignee: General Electric Company, Schenectady, N.Y.

[21] Appl. No.: 656,497

[22] Filed: May 31, 1996

[51] Int. Cl.[6] ..... F25B 19/00

[52] U.S. Cl. ..... 62/51.1; 62/45.1; 62/295; 335/216; 505/893

[58] Field of Search ..... 62/45.1, 51.1, 62/295; 335/216; 505/893

[56] References Cited

U.S. PATENT DOCUMENTS

| | | | |
|---|---|---|---|
| 3,904,067 | 9/1975 | Runiyasu et al. | 62/45.1 |
| 4,777,807 | 10/1988 | White | 62/295 |
| 5,265,430 | 11/1993 | Chen et al. | 62/51.1 |
| 5,317,879 | 6/1994 | Goldberg et al. | 62/51.1 |
| 5,396,206 | 3/1995 | Herd et al. | 62/51.1 |
| 5,410,287 | 4/1995 | Laskaris et al. | 335/216 |
| 5,416,415 | 5/1995 | Dorri et al. | 324/318 |
| 5,442,928 | 8/1995 | Laskaris et al. | 62/51.1 |
| 5,446,433 | 8/1995 | Laskaris et al. | 62/51.1 |

*Primary Examiner*—Ronald C. Capossela
*Attorney, Agent, or Firm*—Douglas E. Erickson; Marvin Snyder

[57] ABSTRACT

A superconductive magnet has a superconductive coil surrounded by a thermal shield surrounded by a vacuum enclosure. The thermal shield has one and preferably several flexible layers of thermally conductive material. A first flexible blanket of multi-layer thermal insulation surrounds the thermal shield within the vacuum enclosure, and a second such flexible blanket surrounds the superconductive coil within the thermal shield. A cryocooler coldhead has a first stage in thermal contact with each of the flexible layers of the thermal shield. At least most of the weight of the thermal shield is supported by the flexible blankets.

12 Claims, 2 Drawing Sheets

SUPERCONDUCTIVE MAGNET HAVING A THERMAL SHIELD

BACKGROUND OF THE INVENTION

The present invention relates generally to a superconducting magnet and more particularly to a superconducting magnet whose superconductive coil is generally surrounded by a thermal shield.

Superconducting magnets are used, or are planned to be used, in various apparatus such as, but not limited to, magnetic resonance imaging (MRI) systems for medical diagnosis, superconductive rotors for electric generators and motors, and magnetic levitation devices for train transportation. Conventional superconductive magnets include at least one superconductive coil surrounded by a 60–250 thousandths-inch-thick rigid thermal shield surrounded by a sturdy vacuum enclosure. The rigid thermal shield, which usually is made of aluminum or copper, reduces heat transfer to help maintain a low cryogenic temperature in the superconductive coil and requires a sturdy support so as to keep the thermal shield spaced-apart from the superconductive coil and the vacuum enclosure to reduce heat transfer. Certain vacuum enclosures for MRI systems have a generally toroidal shape with an open bore and are generally coaxially aligned with the superconductive coil, as are known to those smiled in the art.

It is known to use thermally-insulative rigid spacers in superconductive magnets between the thermal shield and the vacuum enclosure, and between the superconductive coil and the thermal shield, to securely position such magnet components. It is also known to use support members, in place of spacers to attach such magnet components together. A typical vacuum enclosure for a superconductive whole-body MRI magnet may weigh 3,000 pounds and have a diameter of 82 inches, and an associated typical thermal shield may weigh 400 pounds.

Some superconductive magnets are conductively cooled by a cryocooler coldhead (such as that of a conventional Gifford-McMahon cryocooler) whose housing is hermetically connected to the vacuum enclosure, whose first stage extends from the housing into the vacuum enclosure to be in thermal contact with the thermal shield, and whose second stage extends from the first stage to be in thermal contact with the superconductive coil.

Other superconductive magnets are cooled by a dewar containing a liquid cryogen (such as liquid helium) in which is placed the superconductive coil. Two spaced-apart thermal shields surround the dewar, and a vacuum enclosure surrounds the thermal shields. To reduce liquid helium boil-off, it is known to add a cryocooler coldhead whose housing is hermetically connected to the vacuum enclosure, whose first stage is in thermal contact with the outer thermal shield, and whose second stage is in thermal contact with the inner thermal shield.

It is noted that the outer thermal shield is cooled by the first stage of the cryocooler coldhead to reduce heat transfer across the thermal shield, as is well within the understanding of the artisan. It is known to use a blanket of multi-layer insulation, such as crinkled layers of aluminized mylar, between the thermal shield and the vacuum enclosure to further reduce heat transfer.

What is needed is a better-insulated superconductive magnet which is smaller in size, lighter in weight, and lower in cost than conventional magnets.

SUMMARY OF THE INVENTION

It is an object of the invention to provide a superconductive magnet having a thermal shield.

The superconductive magnet of the invention includes a vacuum enclosure, a superconductive coil, a thermal shield, a cryocooler coldhead, and first and second flexible blankets of multi-layer thermal insulation. The superconductive coil is located within and generally spaced apart from the vacuum enclosure. The thermal shield is located within and generally spaced apart from the vacuum enclosure and generally surrounds and generally is spaced apart from the superconductive coil. The thermal shield includes a first flexible layer of thermally conductive material which generally surrounds the superconductive coil and which has a coefficient of thermal conductivity at least as high as one watt per centimeter-Kelvin at a temperature of fifty Kelvin. The cryocooler coldhead has a housing hermetically connected to the vacuum enclosure and has a first stage extending from the housing and located within the vacuum enclosure in thermal contact with the first flexible layer. The first flexible blanket of multi-layer thermal insulation is positioned within the vacuum enclosure, generally surrounds the thermal shield, extends generally to the vacuum enclosure and generally to the thermal shield, and has an effective coefficient of thermal conductivity no higher than one micro-watt per centimeter-Kelvin at a temperature of fifty Kelvin and a pressure of one milli-torr. The second flexible blanket of multi-layer thermal insulation is positioned within the thermal shield, generally surrounds the superconductive coil, extends generally to the thermal shield, and has an effective coefficient of thermal conductivity no higher than one micro-watt per centimeter-Kelvin at a temperature of fifty Kelvin and a pressure of one milli-tort. At least most of the weight of the thermal shield is supported by the first and second flexible blankets.

In a preferred embodiment, the thermal shield also includes a second flexible layer of thermally conductive material which generally surrounds and is generally spaced apart from the first flexible layer, which is in thermal contact with the first stage, and which has a coefficient of thermal conductivity at least as high as one watt per centimeter-Kelvin at a temperature of fifty Kelvin. Preferably, the first and second flexible layers have facing surfaces, and less than generally one percent of the facing surfaces are in physical contact with each other.

Several benefits and advantages are derived from the superconductive magnet of the invention. A thermal shield made up of two (or more) thermally-conductive flexible layers in thermal contact with the first stage of the cryocooler coldhead and having less than generally one percent of contact between facing surfaces will have less heat loss across the thermal shield than will a rigid thermal shield having a thickness equal to the sum of the thicknesses of the flexible layers. By having most (and preferably all) of the weight of the thermal shield be supported by the first and second flexible blankets of multi-layer thermal insulation, the need for a thermal shield support member is eliminated which reduces the size, weight, cost, and complexity of the magnet.

BRIEF DESCRIPTION OF THE DRAWINGS

The accompanying drawings illustrate a preferred embodiment of the present invention wherein.

DETAILED DESCRIPTION OF THE INVENTION

Figure 1:
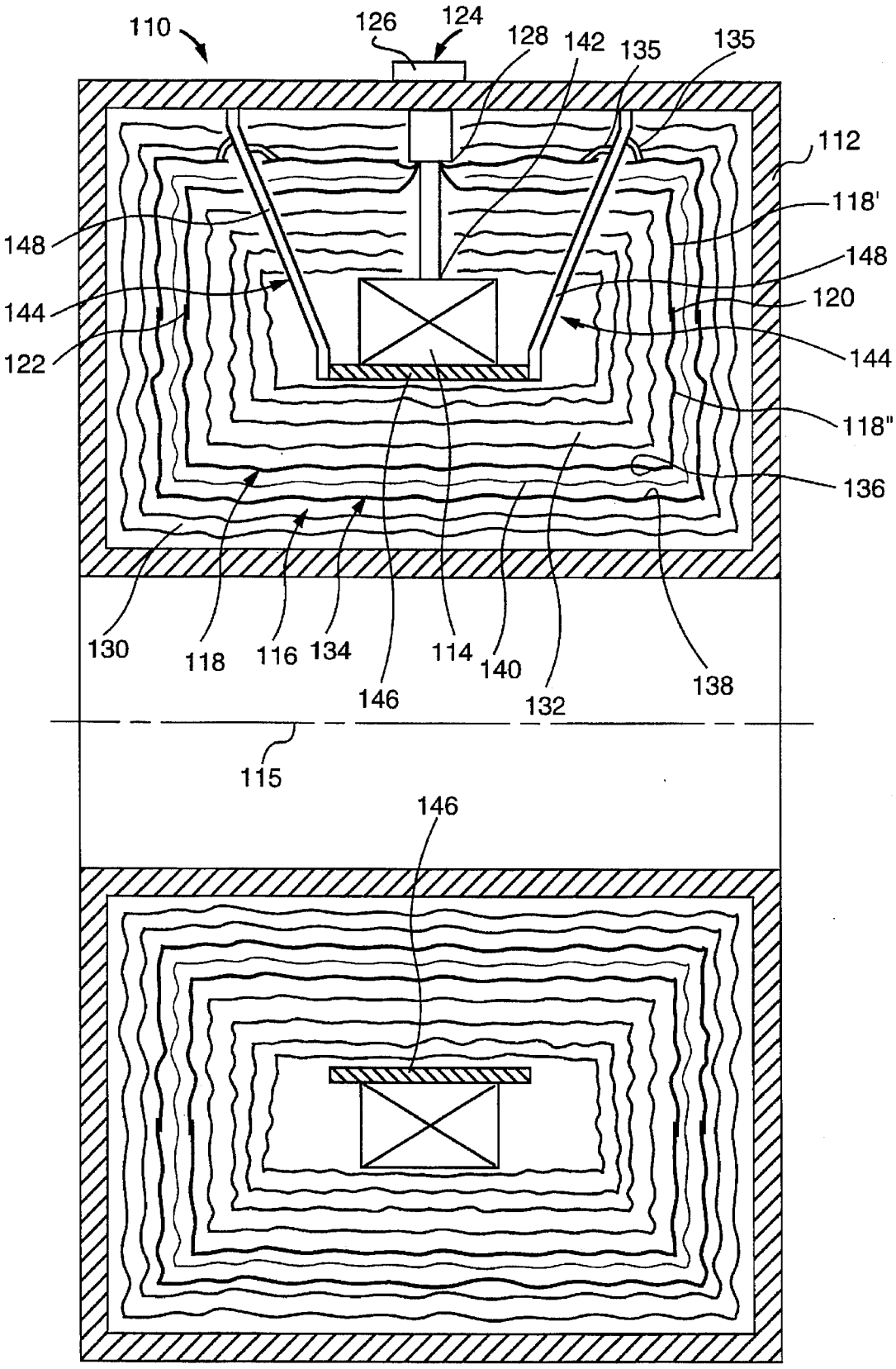
FIG. 1 is a schematic cross-sectional view of a first preferred embodiment of the superconductive magnet of the invention including a cryocooler coldhead.

Referring now to the drawings, FIG. 1 schematically shows a first preferred embodiment of the superconductive magnet 110 of the present invention. The superconductive magnet 110 has a vacuum enclosure 112 and a superconductive coil 114 disposed within and generally spaced apart from the vacuum enclosure 112. In a preferred construction, the vacuum enclosure 112 has a generally toroidal shape and has a generally-longitudinally-extending axis 115, and the superconductive coil 114 has a generally solenoidal shape and is generally coaxially aligned with the vacuum enclosure 112. Typical superconductive magnets contain several additional superconductive coils (not shown) within the vacuum enclosure. Superconductive coils are usually wound from superconductive wire or tape, such as (but not limited to) niobium-titanium superconductive wire. A typical range of vacuums within the vacuum enclosure 112 is between generally $10^{-7}$ and generally $10^{-3}$ tort.

The superconductive magnet 110 also has a thermal shield 116 disposed within and generally spaced apart from the vacuum enclosure 112 and generally surrounding and generally spaced apart from the superconductive coil 114. The thermal shield 116 includes a first flexible layer 118 of thermally conductive material which generally surrounds the superconductive coil 114, which necessarily is generally spaced apart from the vacuum enclosure 112 and the superconductive coil 114, and which has a coefficient of thermal conductivity at least as high as one watt per centimeter-Kelvin at a temperature of fifty Kelvin. A coefficient of thermal conductivity relates to heat transfer by solid conduction only, as is known to the artisan. Preferably, the first flexible layer 118 has a thickness of between generally one thousandth and generally twenty-five thousandths of an inch. A more preferred range is between generally one thousandth and ten-thousandths of an inch. In a preferred construction, the first flexible layer 118 includes two discrete portions 118' and 118" together having two sets 120 and 122 of overlapping and thermally-connected edges joined together by an epoxy film or an adhesive bond. A preferred thermally conductive material for the first flexible layer 118 is annealed OFHC (oxygen-free hard copper) copper. In an exemplary embodiment, the first flexible layer 118 is reflective to radiant heat, as can be appreciated by those skilled in the art.

The superconductive magnet 110 additionally includes a cryocooler coldhead 124, such as that of a Gifford McMahon cryocooler. The cryocooler coldhead 124 has a housing 126 hermetically connected to the vacuum enclosure 112. The cryocooler coldhead 124 also has a first stage 128 extending from the housing 126 and disposed within the vacuum enclosure 112 in thermal contact with the first flexible layer 118 of the thermal shield 116.

The superconductive magnet 110 further includes first and second flexible blankets 130 and 132 of multi-layer thermal insulation. The first flexible blanket 130 is disposed within the vacuum enclosure 112, generally surrounds the thermal shield 116, extends generally to the vacuum enclosure 112 and generally to the thermal shield 116, and has an effective coefficient of thermal conductivity no higher than one micro-watt per centimeter-Kelvin at a temperature of fifty Kelvin and a pressure of one milli-torr. The second flexible blanket 132 is disposed within the thermal shield 116, generally surrounds the superconductive coil 114, extends generally to the thermal shield 116, and has an effective coefficient of thermal conductivity no higher than one micro-watt per centimeter-Kelvin at a temperature of fifty Kelvin and a pressure of one milli-torr. An effective coefficient of thermal conductivity for multi-layer thermal insulation in a vacuum enclosure relates to heat transfer by solid contact conduction between insulation layers, by residual gas conduction in the vacuum enclosure, and by radiation between insulation layers, as is known to the artisan. A preferred multi-layer thermal insulation for the first and second flexible blankets 130 and 132 is aluminized mylar having an individual layer thickness of between two ten-thousandths and one thousandth of an inch. Other choices include other reflective, metalized, composite films where each layer is crinkled (or adjoining layers have an intervening silk or rayon net or mesh spacer layer) for layer-spacing purposes to improve insulation effectiveness, such spacing being known in the art. Each layer may have two portions with overlapping, taped-together edges (not shown in the figures). Most of the weight (and preferably generally all of the weight) of the thermal shield 116 is supported by the first and second flexible blankets 130 and 132, and the multi-layer thermal insulation will be somewhat compressed due to the weight of the thermal shield 116 (such compression being omitted from the figures for clarity).

It is preferred that the thermal shield 116 also include a second flexible layer 134 of thermally conductive material which generally surrounds and is generally spaced apart from the first flexible layer 118, which necessarily is generally spaced-apart from the vacuum enclosure 112 and the superconductive coil 114, which is in thermal contact with the first stage 128 of the cryocooler coldhead 124, and which has a coefficient of thermal conductivity at least as high as one watt per centimeter-Kelvin at a temperature of fifty Kelvin. Preferably, the second flexible layer 134 is generally identical to the first flexible layer 118. The first and second flexible layers 118 and 134 have facing surfaces 136 and 138. Preferably less than generally one percent of the facing surfaces 136 and 138 are in physical contact with each other. More preferably less than one-half of a percent, and most preferably zero percent, of the facing surfaces 136 and 138 are in physical contact with each other. Typical applications will require three to five separate flexible layers (only two of which are shown in the figures for clarity) for the thermal shield 116, although a particular design may call for only a first flexible layer 118 or may call for more than five flexible layers. Each flexible layer may include stand-off dimples or the like to provide for minimum surface contact.

In an exemplary embodiment, the thermal shield 116 moreover includes a first flexible spacer stratum 140 which is disposed between the first and second flexible layers 118 and 134, which necessarily is generally spaced-apart from the vacuum enclosure 112 and the superconductive coil 114, which generally surrounds the first flexible layer 118, and which has an effective coefficient of thermal conductivity no higher than one micro-watt per centimeter-Kelvin at a temperature of fifty Kelvin and a pressure of one milli-tort. A preferred first flexible spacer stratum 140 is aluminized mylar having a thickness of between generally one thousandth and generally twenty thousandths of an inch. Other preferred materials for the first flexible spacer stratum include rayon and silk net or mesh. Such spacer strata need not be reflective (i.e., they may absorb radiative heat).

In the first preferred embodiment, the cryocooler coldhead 124 also includes a second stage 142 extending from the first stage 128. The second stage 142 is colder than the first stage 128, as is known to the artisan. As shown in FIG. 1, the superconductive coil 114 is in thermal contact with the second stage 142. Preferably, the second flexible blanket 132 extends generally to the superconductive coil 114. In this embodiment, the superconductive magnet 110 includes a coil support member 144 which penetrates the thermal shield 116 and extends between and is attached to the superconductive coil 114 and the vacuum enclosure 112. The coil support member 144 has a coil form 146, about which the superconductive coil 114 is wound, and has support arms 148. The support arms 148 penetrate the thermal shield 116 and attach the coil form 146 to the vacuum enclosure 112. The coil support member 144 is in thermal contact with the second flexible layer 134 of the thermal shield 116. In a preferred construction, copper thermal braid 135 thermally connects the support arms 148 of the coil support member 144 to the second flexible layer 134 of the thermal shield 116 to intercept heat conducting down the support arms 148 from the typically room-temperature vacuum enclosure 112.

Figure 2:
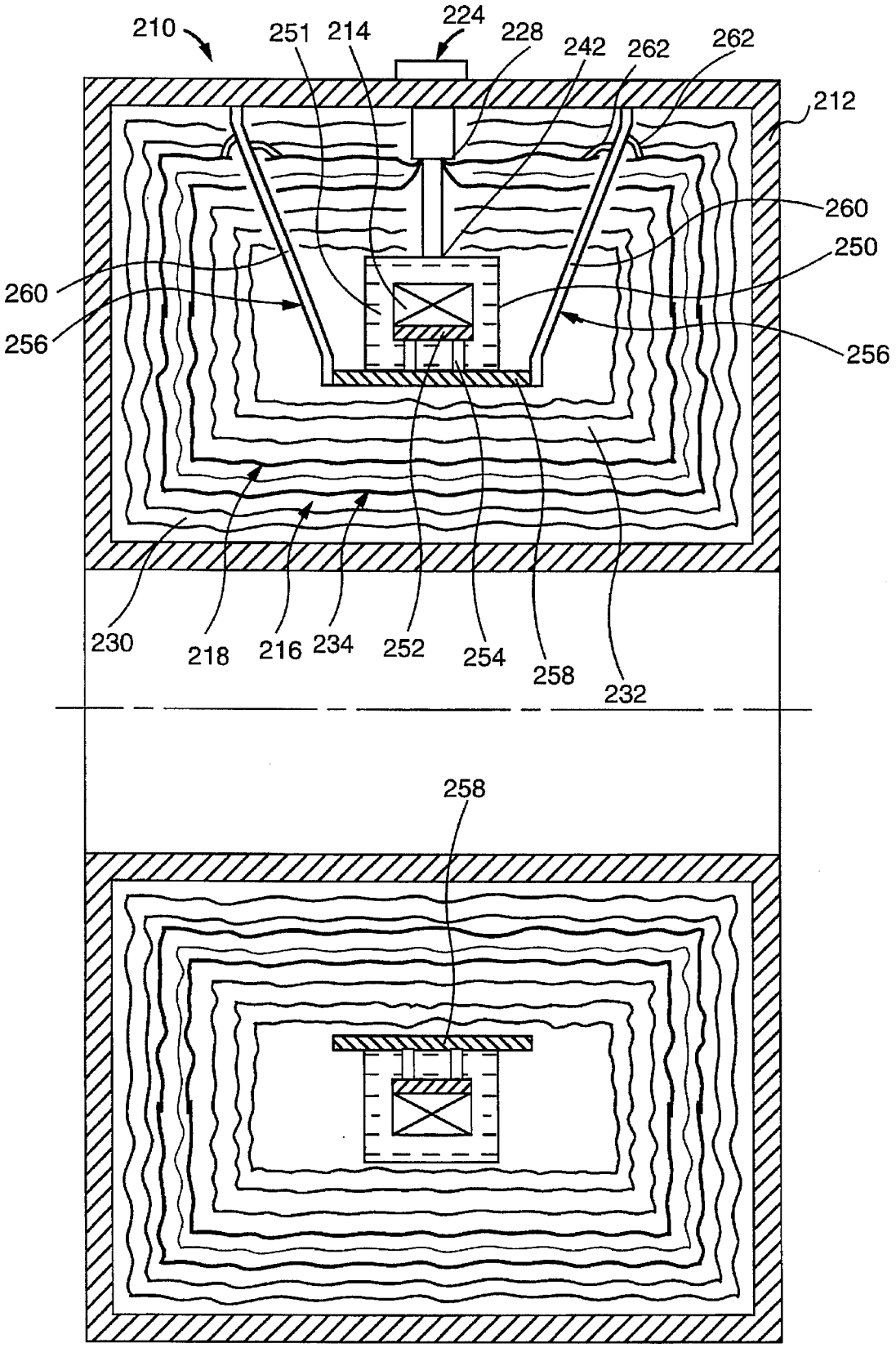
FIG. 2 is a schematic cross-sectional view of a second preferred embodiment of the superconductive magnet of the invention including a cryocooler coldhead and a liquid-cryogen dewar.

FIG. 2 schematically shows a second preferred embodiment of the superconductive magnet 210 of the present invention. The superconductive magnet 210 of the second preferred embodiment is generally identical to the previously-described superconductive magnet 110 of the first preferred embodiment, except for basically the addition of a liquid-cryogen dewar 250 containing a liquid cryogen 251 (such as liquid helium). The liquid-cryogen dewar 250 is disposed within the second flexible blanket 232 and surrounds the superconductive coil 214. The superconductive coil 214 is at least partially immersed in the liquid cryogen 251, and is supported on a coil form 252 through mechanical spacers 254. The second flexible blanket 232 extends generally to the liquid-cryogen dewar 250. The superconductive magnet 210 includes a dewar support member 256 penetrating the thermal shield 216 and extending between and attached to the liquid-cryogen dewar 250 and the vacuum enclosure 212. The dewar support member 256 has a rim portion 258 attached to the liquid-cryogen dewar 250 and support arms 260. Alternately, the support arms could attach directly to the liquid cryogen dewar (such attachment not shown in the figures). The support arms 260 penetrate the thermal shield 216 and attach the rim portion 258 to the vacuum enclosure 212. The dewar support member 256 is in thermal contact with the second flexible layer 234 of the thermal shield 216. In a preferred construction, copper thermal braid 262 thermally connects the support arms 260 of the dewar support member 256 to the second flexible layer 234 of the thermal shield 216. In an exemplary embodiment, the cryocooler coldhead 224 also includes a second stage 242 extending from the first stage 228, and the liquid-cryogen dewar 250 is in thermal contact with the second stage 228 to help prevent boil-off of the liquid cryogen 251.

In a mathematical example, first and second flexible blankets were in place, a cryocooler coldhead having only a first stage at a temperature of twenty Kelvin was in thermal contact with each of four flexible (two-thousandths-inch-thick) layers of a thermal shield (with a flexible spacer stratum between adjoining layers), the temperature of the vacuum enclosure was three-hundred Kelvin (room temperature), and the temperature of the liquid-helium dewar was four Kelvin. The cryocooler coldhead extracts the heat intercepted by the thermal shield. Engineering analysis showed the highest temperature of the outermost flexible layer of the thermal shield was generally eighty Kelvin at a location furthest away from the single stage of the cryocooler coldhead, the highest temperature of the second outermost flexible layer was generally fifty Kelvin, the highest temperature of the third outermost layer was generally thirty Kelvin, and the highest temperature of the innermost layer was generally twenty Kelvin. If a conventional, rigid thermal shield having the same total thickness as the four layers (including the spacer strata) of the invention was used, the highest temperature of the conventional, rigid thermal shield was mathematically analyzed to be generally thirty-five Kelvin and the average temperature was calculated to be generally twenty-eight Kelvin. The weight of the thermal shield of the superconductive magnet of the invention was calculated to be only about twenty percent of the weight of a thermally-equivalent, conventional, rigid, aluminum thermal shield and associated support structure suspending the shield from the vacuum enclosure. The heat leak between room temperature and the dewar was computed to be approximately fifty percent higher with the same-thickness, conventional, rigid thermal shield than with the four-flexible-layer thermal shield of the invention. In many dewar applications, only one thermal shield of the invention is needed where previously two spaced-apart, conventional, rigid thermal shields would be required.

The present invention provides a superconductive magnet 110 and 210 having a low-cost, flexible, lightweight, self-supported thermal shield 116 and 216 that is easily installed and that is integrated into the first and second flexible blankets of multi-layer thermal insulation 130 & 132 and 230 and 232. By anchoring thin first and second flexible layers 118 & 134 and 218 & 234 of thermally conductive material to a common first stage 128 and 228 of a cryocooler coldhead 124 and 224, only one cryocooler is required to achieve a highly effective thermal shield.

The foregoing description of several preferred embodiments of the invention has been presented for purposes of illustration. It is not intended to be exhaustive or to limit the invention to the precise form disclosed, and obviously many modifications and variations are possible in light of the above teaching. It is noted that the terminology "thermal contact" includes direct structural contact as well as indirect structural contact. It is intended that the scope of the invention be defined by the claims appended hereto.

We claim:

1. A superconductive magnet comprising:

a) a vacuum enclosure;

b) a superconductive coil disposed within and generally spaced apart from said vacuum enclosure;

c) a thermal shield disposed within and generally spaced apart from said vacuum enclosure and generally surrounding and generally spaced apart from said superconductive coil, said thermal shield including a first flexible layer of thermally conductive material which generally surrounds said superconductive coil and which has a coefficient of thermal conductivity at least as high as one watt per centimeter-Kelvin at a temperature of fifty Kelvin;

d) a cryocooler coldhead having a housing hermetically connected to said vacuum enclosure and having a first stage extending from said housing and disposed within said vacuum enclosure in thermal contact with said first flexible layer;

e) a first flexible blanket of multi-layer thermal insulation disposed within said vacuum enclosure, generally surrounding said thermal shield, extending generally to said vacuum enclosure and generally to said thermal shield, and having an effective coefficient of thermal conductivity no higher than one micro-watt per centimeter-Kelvin at a temperature of fifty Kelvin and a pressure of one milli-torr; and f) a second flexible blanket of multi-layer thermal insulation disposed within said thermal shield, generally surrounding said superconductive coil, extending generally to said thermal shield, and having an effective coefficient of thermal conductivity no higher than one micro-watt per centimeter-Kelvin at a temperature of fifty Kelvin and a pressure of one milli-torr, wherein at least most of the weight of said thermal shield is supported by said first and second flexible blankets.

2. The superconductive magnet of claim 1, wherein said first flexible layer has a thickness of between generally one thousandth and generally twenty-five thousandths of an inch.

3. The superconductive magnet of claim 1, wherein said first flexible layer includes two discrete portions together having a pair of overlapping and thermally-connected edges.

4. The superconductive magnet of claim 1, wherein said thermal shield also includes a second flexible layer of thermally conductive material which generally surrounds and is generally spaced apart from said first flexible layer, which is in thermal contact with said first stage, and which has a coefficient of thermal conductivity at least as high as one watt per centimeter-Kelvin at a temperature of fifty Kelvin.

5. The superconductive magnet of claim 4, wherein said first and second flexible layers have facing surfaces, and wherein less than generally one percent of said facing surfaces are in physical contact with each other.

6. The superconductive magnet of claim 5, also including a liquid-cryogen dewar disposed within said second flexible blanket and surrounding said superconductive coil, and wherein said second flexible blanket extends generally to said liquid-cryogen dewar.

7. The superconductive magnet of claim 6, also including a dewar support member penetrating said thermal shield and extending between and attached to said liquid-cryogen dewar and said vacuum enclosure, and wherein said dewar support member is in thermal contact with said second flexible layer.

8. The superconductive magnet of claim 6, wherein said cryocooler coldhead also includes a second stage extending from said first stage, and wherein said liquid-cryogen dewar is in thermal contact with said second stage.

9. The superconductive magnet of claim 5, wherein said cryocooler coldhead also includes a second stage extending from said first stage, wherein said superconductive coil is in thermal contact with said second stage, and wherein said second flexible blanket extends generally to said superconductive coil.

10. The superconductive magnet of claim 9, also including a coil support member penetrating said thermal shield and extending between and attached to said superconductive coil and said vacuum enclosure, and wherein said coil support member is in thermal contact with said second flexible layer.

11. The superconductive magnet of claim 10, wherein said first flexible spacer stratum has a thickness of between generally one thousandth and generally twenty thousandths of an inch.

12. The superconductive magnet of claim 4, wherein said thermal shield also includes a first flexible spacer stratum disposed between said first and second flexible layers, generally surrounding said first flexible layer, and having an effective coefficient of thermal conductivity no higher than one micro-watt per centimeter-Kelvin at a temperature of fifty Kelvin and a pressure of one milli-torr.

* * * * *